United States Patent [19]

Woerner

[11] Patent Number: 4,531,722

[45] Date of Patent: Jul. 30, 1985

[54] FOLDING APPARATUS RECEIVING PRINTED PRODUCTS FROM A ROTARY PRINTING MACHINE AND METHOD OF REDEPOSITION

[75] Inventor: Michael Woerner, Neusäss, Fed. Rep. of Germany

[73] Assignee: M.A.N.-Roland Druckmaschinen Aktiengesellschaft, Offenbach, Fed. Rep. of Germany

[21] Appl. No.: 630,700

[22] Filed: Jul. 13, 1984

[30] Foreign Application Priority Data

Jul. 15, 1983 [DE] Fed. Rep. of Germany ..... 3325543

[51] Int. Cl.[3] ..... B42C 1/10

[52] U.S. Cl. ..... 270/47; 270/48

[58] Field of Search ..... 270/20.1, 4–9, 270/11, 13–19, 41–42, 47–51

[56] References Cited

U.S. PATENT DOCUMENTS

| | | | |
|---|---|---|---|
| 253,325 | 2/1882 | Tucker | 270/47 |
| 374,930 | 12/1887 | Brooks | 270/47 |
| 397,314 | 2/1889 | Scott | 270/47 |
| 439,306 | 10/1890 | Scott | 270/47 |
| 1,029,140 | 6/1912 | Morgan | 270/48 |
| 1,286,120 | 11/1918 | Seymour | 270/47 |
| 4,190,243 | 2/1980 | Michalik et al. | 270/42 |

FOREIGN PATENT DOCUMENTS 1204689 11/1965 Fed. Rep. of Germany .

*Primary Examiner*—E. H. Eickholt

*Attorney, Agent, or Firm*—Frishauf, Holtz, Goodman & Woodward

[57] ABSTRACT

To permit high-speed operation of a longitudinal folding apparatus in which a folding blade engages between two folding rollers (11), the folding blade and the folding rollers of the folding apparatus (7) are made sufficiently long to accomodate a plurality of essentially immediately adjacently positioned printed products. The printed products are supplied by a transport system (1, 20) with spacing by about the length of a product therebetween, and, in accordance with the invention, are repositioned immediately adjacent each other, with gaps between immediately adjacent products longer than the spacing between products as supplied. Repositioning is effected by removing selected products from the transport system, guiding them in an auxiliary transport path formed by the circumference of a gripper drum, or of an auxiliary belt system, located along the transport system and repositioning the products, after transporting in the auxiliary transport path, at the selected position back on the transport system and immediately adjacent a subsequently supplied product which was not deflected into the auxiliary transport path.

10 Claims, 9 Drawing Figures

FOLDING APPARATUS RECEIVING PRINTED PRODUCTS FROM A ROTARY PRINTING MACHINE AND METHOD OF REDEPOSITION

REFERENCE TO RELATED PUBLICATION

German Published Patent Application DE-AS No. 1 204 689.

The present invention relates to folding apparatus, and more particularly to high-speed folding apparatus to form a transverse fold in a plurality of printed products, simultaneously, received for example from a rotary printing machine, or longitudinal folding apparatus coupled thereto.

BACKGROUND

Increasing the output speed of rotary printing machines is sometimes limited by the output apparatus to which the machines are coupled. One such output apparatus is a longitudinal folding apparatus. Longitudinal folding apparatus usually are so constructed that the material to be folded is passed transversely with respect to its supply direction through folding rollers. It is important that the rear or trailing edge of the product to be folded, during the folding operation, which no longer moves in the supply direction, has left the plane of the next product to be folded before the next product to be folded arrives. The time which is required for the product which is being folded until its trailing edge leaves the plane of the supply or transport belts—which are usually provided—is considerable and, upon high-speed production, the transport system may pass over a substantial distance. During that time, and as this distance is passed, a subsequent printed product may be supplied. The subsequent printing product, however, must be prevented from engaging or impinging on the product which is just being folded since, otherwise, the products may be damaged, or shifted in position, that is, the product then being folded may no longer be folded along the predetermined folding line.

It has previously been proposed—see the referenced German Patent Publication DE-AS No. 1 204 689—to split the stream of the products to be folded to two paths, each one being directed to an individual longitudinal folding apparatus. This solution, while providing for high-speed output, is expensive since it requires duplication of the folding apparatus, additional space for the additional folding apparatus, and for the additional transport path.

THE INVENTION

It is an object to provide a folding apparatus permitting longitudinal folds which is suitable for high production speeds while requiring only small modification of existing apparatus and little or no additional space.

Briefly, an auxiliary transport path is formed on or above or adjacent the main transport path which supplies printed products to a folding apparatus, the auxiliary transport path having a path length which is longer by at least the length of one of the products than the direct transport path. The auxiliary transport path receives, for example, every second or every third sheet or product to be folded, and redeposits that sheet, at a different position along the main transport path. The folding apparatus itself is made at least as long as the overall length of adjacently positioned products which are supplied thereto after the products in the auxiliary transport path have been returned to the main transport system.

The invention utilizes the feature customary in many high-speed transport systems that the printed products, as derived for example from a rotary printing machine, are spaced along the transport path with gaps which are, usually, about the length of the printed product itself, usually slightly more. The invention, thus, provides for repositioning of the printed products so that at least two of them will then be located adjacent each other, with a longer gap between adjacently positioned products, the adjacently positioned products then being folded in a common folding apparatus which, however, is axially longer than the one originally provided, for example in accordance with the prior art.

The system has the advantage that mere repositioning of the products being supplied to the longitudinal folding apparatus permits saving of a second individual folding apparatus and the associated transport system, including all space therefor. The relocation of the printed products on an existing belt can be carried out easily and simply by well-known apparatus customary in the printing industry.

DRAWINGS

DETAILED DESCRIPTION

Figure 1:
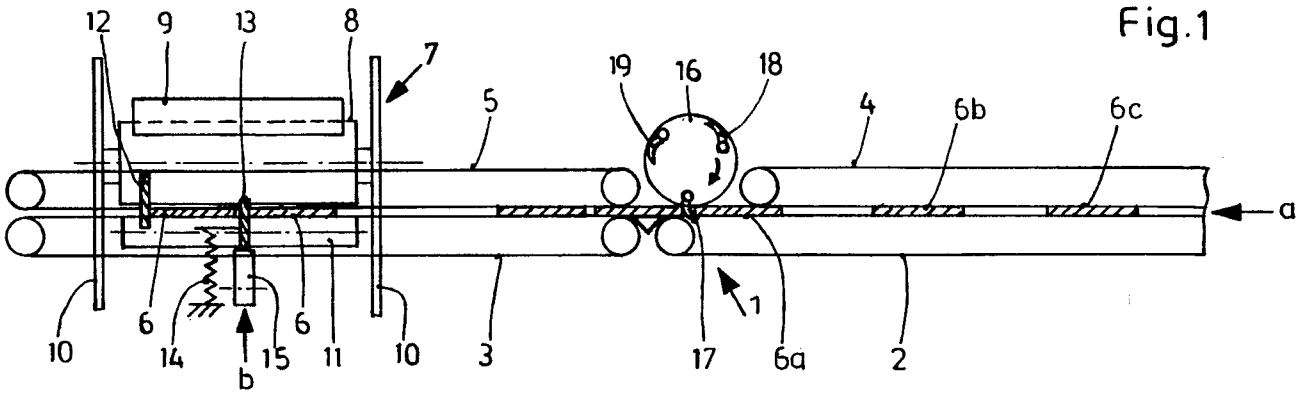
FIG. 1 is a schematic side view of one embodiment of the folding and supply apparatus in accordance with the present invention.

A transport system 1, which, for example, is constructed of a plurality of adjacently positioned narrow belts 2 and 3 beneath the products as well as upper hold-down belts 4 and 5 supplies printed products 6 to a longitudinal folding apparatus 7. Rather than using separate narrow belts 2, 3, continuous lower belts having the extent of the belts 2, 3, can be used. The transport system 1 feeds products 6, 6*a*, 6*b*, 6*c* . . . in the direction of the arrow a. The products 6, 6*a* . . . are received from a transverse folding apparatus—not shown—which, in turn, is coupled to a rotary printing press (not shown) and are supplied in distances which are about the length of one of the products. The belts 3, 5 extend through the longitudinal folding apparatus 7.

The longitudinal folding apparatus 7 is constructed, basically, as well known and includes a carrying cylinder 8 on which a folding blade 9 is pivotably secured. The folding cylinder 8 is journaled between two side walls 10. Two folding rollers 11 are located in the side walls 10. The folding rollers 11, of which only the forward one is shown, are located behind each other, with respect to the plane of the drawing. The length of the folding rollers 11 and of the folding blade 9 is so dimensioned that, at one time, at least two of the printed products 6 can be folded. Thus, the folding rollers 11 and the blade 9 have a length which corresponds at least to the overall length of adjacently supplied products, typically two adjacently supplied products, including a clearance space between the respective products. The longitudinal folding apparatus 7 further includes a fixed stop member 12 for the leading or forward product—in the direction of the feed, arrow a—and further a movable stop 13 for the rearward product. The stop 13 is longitudinally movable up and down, that is, in the direction of the arrow b, or counter the direction, by a suitable reciprocating mechanism, for example a rotary eccenter 15, moving the stop 13 up and down, the stop 13 being retracted by a spring 14 coupled thereto. The stop 13 is longitudinally guided in a suitable guideway, not shown, and of any standard construction. Upon rotation of eccenter 15, stop 13 is moved, in dependence on the supply speed, and in synchronism therewith, of the transport belt system 2, 3 into the plane of the belt system 2, as seen in FIG. 1, and thereafter pulled away from that plane to permit the next product to be fed to the stop 12, then to be moved upwardly to separate the next two products from each other.

In accordance with a feature of the invention, an auxiliary path is provided for selected products, by switching selected products into the auxiliary path. As seen in FIG. 1, the auxiliary path is defined by the circumference of a deflection drum 16, which is rotatably journaled above the transport belt 2. The deflection drum 16 is driven by a suitable drive—not shown—with a circumferential speed which corresponds to the speed of the transport system 1. The circumference of the drum 16 corresponds approximately to three times the length of one of the products 6. The drum 16 includes three rows of grippers 17, 18, 19 which are pivotably located at the circumference thereof.

Figure 4:
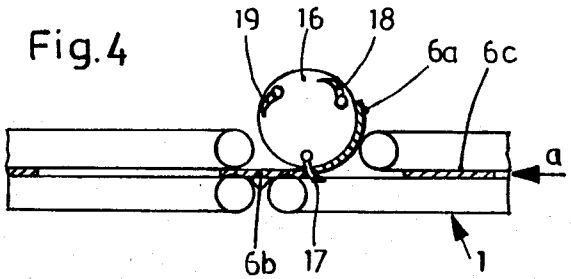
FIGS. 2, 3 and 4 are fragmentary illustrations of a portion of the system of FIG. 1, showing the system in different operating phases.
Figure 2:
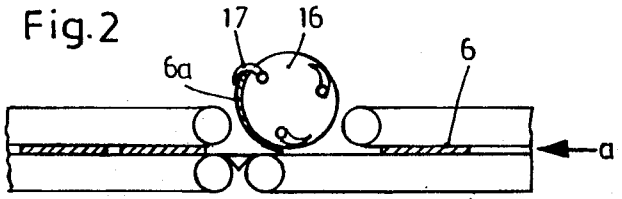
Figure 3:
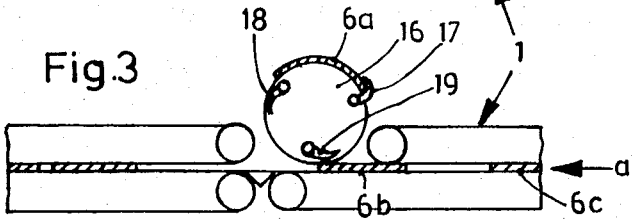

Operation: As seen in FIG. 1, the grippers 17 grip a product *6a*, pick up the product—see FIG. 2—and remove it from the transport path 1, and thus move the product *6a* in the auxiliary path. As the drum 16 rotates, the transport belts of the transport system 1 feed the next product *6b* in the direction of the arrow a. As best seen in FIGS. 3 and 4, the next product *6b* will pass beneath the drum 16, since the grippers 18, 19 in those positions, are controlled to match the circumference of the drum 16, and do not pick up any product. After the product *6b* has passed beneath the drum, the drum 16 will have reached the position of FIG. 4, and the product *6a* is again returned to the transport system 1. Only a small gap will remain between the products *6b*, *6a*—that now being the position in which they will be transported on the system 1—just enough in order to permit the movable stop 13 on the folding apparatus 7 to separate the two products. Starting from the position shown in FIG. 4, the rows of grippers 18 then will grip the next product *6c*, deflect the product around the drum 16 and deposit the product *6c* behind the then following product *6d* (not shown), product *6d* being fed along the path 1 without deflection.

Figure 7:
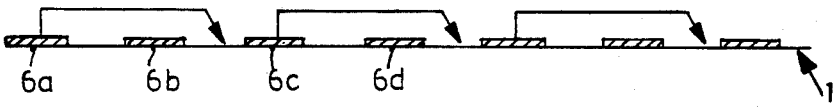
FIGS. 7, 8 and 9 are schematic illustrations showing possibilities for repositioning of printed products on a transport path.

The repositioning of the respectively staggered and spaced products which are supplied on the belt system 1 is best seen in FIG. 7. Product *6a* is deflected and repositioned behind product *6b*, thus forming an essentially continuous path between products *6b*, *6a*—in that order—for feeding to the folding apparatus 7, closely adjacent each other. Thereafter, the deflection drum 16 will grip the product *6c*, and deposit it behind the product *6d*. Consequently, a distance will be formed between the products *6a* and *6d* which is about twice the distance between any two products initially supplied by the belt system 1. Consequently, the folding process of the two, now quite closely adjacent products *6a*, *6b* will be longer until the leading edge of the next two closely positioned products *6d*, *6c* runs between the folding rollers 11 and the folding blade 9. This insures that the trailing edge of the product *6a* reliably has been pulled out of the way of the leading edge of the following product *6d*, when the product *6d* reaches the region of the folding rollers 11.

The system is versatile and can be readily changed; as described, the deflection drum 16 deflects alternately supplied products and deposits the so deflected products behind the intermediate ones which are fed, undeflected, through the transport path 1. The longitudinal folding apparatus, thus, will receive two closely spaced products, for simultaneous folding and handling, behind which two products will be a gap or distance to the next subsequent two products of not quite double the length of the products.

Figure 9:
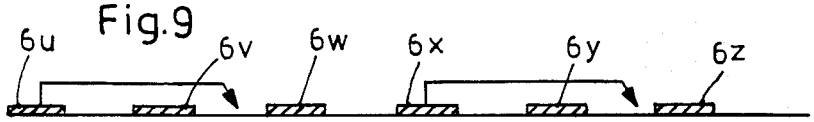

The deflection drum can be so arranged that the grippers thereof are controlled to grip, for example, each third product, as shown in the schematic arrangement of FIG. 9. First, a product *6u* is gripped by the grippers 17 of the deflection drum 16 and, after one revolution, is deposited behind the product *6v*, and immediately adjacent the product *6w*. The drum 16 then revolves by one complete revolution without picking up a product from the belt system 1. Consequently, the products *6v*, *6u* and *6w* are supplied, sequentially, to the longitudinal folding system 7 and can be folded in one operating folding step. In this arrangement, the folding apparatus 7 must have a length to accept three products, and two separating elements 13 are needed.

After one revolution of the drum 16, without having deflected or gripped any products, the grippers 17 then grip the product *6x*, and deposit it after a further revolution behind the product *6y*, and immediately in front of the product *6z*. The next folding operation for the products *6y*, *6x*, *6z* will again occur simultaneously, similar to the arrangement described in connection with the products *6z*, *6u*, *6w*. This arrangement, of course, presupposes that the folding blade 9 and the rollers 11 are sufficiently long to be able to accept three products at the same time. The stops 12, 13 are not strictly necessary, but desirable. If the stops 12, 13 are used, the system should be so arranged that the spacing of the trailing edge of one product to the leading edge of the next product be slightly longer than the length of a product. This may require slight increase of the spacing between the products, which is readily obtainable by suitable adjustment of a previously connected transverse folding apparatus, or output belt systems from a rotary printing machine.

Figure 5:
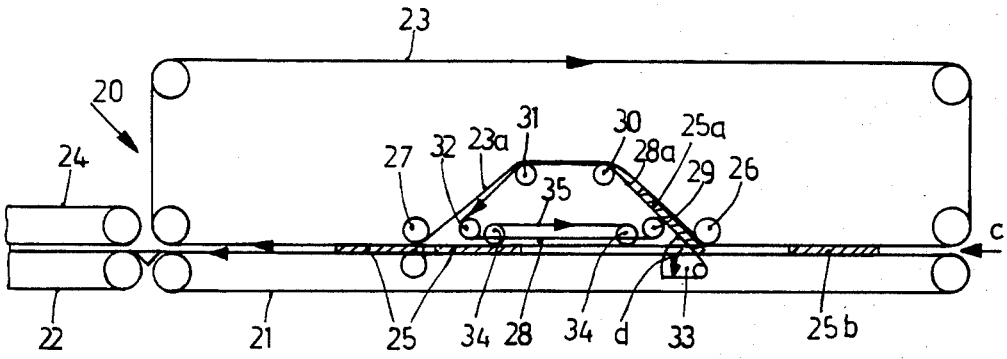
FIG. 5 illustrates another embodiment of the invention.
Figure 6:
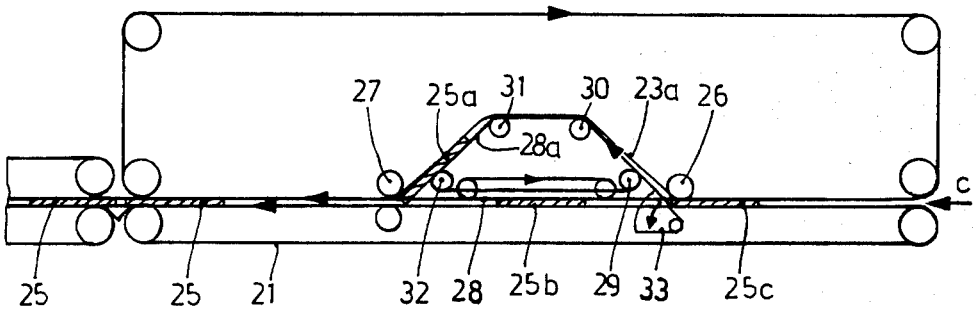
FIG. 6 illustrates the apparatus of FIG. 5 in a different operating phase.

Embodiment of FIGS. 5 and 6: The belt system 20 is constituted of a plurality of adjacently located narrow lower belts 21, 22, and upper belts 23, 24. Products 25, *25a*, *25b*, *25c*, . . . are transported in the direction of the arrow c from a transverse folding system (not shown) to a longitudinal folding system 7, not shown in FIG. 5, and similar to the longitudinal system 7 illustrated in FIG. 1.

The upper belts 23 are lifted off the lower belts 21 during a zone defined by the distance between deflection rollers 26, 27. Within this zone, a plurality of narrow deflection rollers 28 are located adjacent each other, which are guided about rollers 29, 30, 31, 32. The belts 28 are driven with the same speed as the belt of the system 20, so that the upper run *28a* of any belt 28 runs in the same direction as the deflected run *23a* of a belt system. Two transport paths are provided for products which arrive in the direction of the arrow c, by a deflection switch 33. One of the paths is straight through along the lower belts 21; the other path is first along the lower belts 21, and then along and beneath the upper belts 23, and the upper run 28*a* of the deflection belt system 28. The other path, then, is between the deflected run 23*a* of the upper belt 23 and the upper run 28*a* of the belts 28, then at an angular inclination along the path defined by the deflection rollers 31, 32 and back to the lower belts 21.

The deflection switch 33 controls the path which the respective products are to take, deflection switch 33 being located just behind deflection roller 26, as best seen in FIG. 5, in which the deflection switch is shown in the position in which a product is deflected in the upward or auxiliary path. The deflection switch, when moved counter the direction of the arrow d, permits deflection of a product into the auxiliary path; upon pivoting the deflection switch in the direction of the arrow d, a straight-through path of the products on the lower belts 21 will be commanded. To hold the products upon straight-through passage against the lower belts 21, further contact belts 35, guided about rollers 34, are provided. The speed of the belts 35 is the same as the speed of the belts 21, and 23, respectively.

The deflection rollers 26, 27, 29–32 are so arranged that the length of the auxiliary supply path of the belts 23 between the switch 33, which defines a removal position, and the return position in the region of the deflection roller 27 is longer by about the length of one product than the length of the supply path of the belt system between the removal position at the switch 33 and the resupply position at the roller 27.

The arrangement as illustrated in FIG. 5 shows one operating condition, in which the product 25*a* is fed between the belts 28 and the deflected run 23*a* of the upper belts 23. As soon as the trailing end of the product 25*a* has left the switch 23, switch 23 is moved in the direction of the arrow d in the undeflected position, so that the next product 23*b* will be fed in straight-through line on the belts 21. Since the feed length of the auxiliary path of the deflection belts 28 is longer by about the length of one product than the feed path of the lower belts 21—as best seen in FIG. 6—product 25*a* is fed shortly in advance of the product 25*b* back to the lower belts 21, at the return position just before the deflection roller 27. As small distance will be left between the products 25*a*, 25*b*, just sufficient in order to permit the movable stop 13 of the longitudinal folding system 7 to be inserted between the two products 25*a*, 25*b*. The switch 23 will be reset immediately after the product 25*b* has passed the switch 33 into the position of FIG. 5, so that the next arriving product 25*c* is again fed into the auxiliary path—see FIG. 5.

Figure 8:
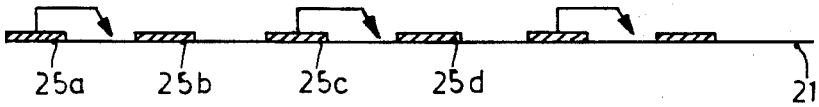

The feed diagram is best seen in FIG. 8, which shows that every other product 25*a*, 25*c* is deflected and again redeposited in advance of the subsequent product 25*b*, 25*d*, respectively. Thus, two products will be immediately adjacent each other, and fed in that position to the longitudinal folding apparatus 7. A distance of about double the length of the products will obtain behind the two closely adjacent products until the next pair of products arrives.

Various changes and modifications may be made, and any features described herein may be used with any of the others, within the scope of the inventive concept.

I claim:

1. Folding apparatus to receive printed products (6, 25) from a rotary printing machine comprising the combination of a rotary folding apparatus (7) to form a longitudinal fold in the products with a transport system (1, 20) removing the products from the printing machine and feeding the products to the folding apparatus wherein the transport system feeds the products in spaced arrangement, in which the products are spaced from each other by about the linear distance of the length of a product, and the folding apparatus comprises a roller means (11) and a folding blade (9) mounted to pass adjacent the roller means and to press a zone of the products overlying the roller means adjacent the roller means and thereby fold a product, and wherein, in accordance with the invention, means for providing an auxiliary transport path (16; 28–32) are provided located along the transport system and positioned for removing a product from the transport path at a removal position and returning the removed product again to the transport path at a return position;

means (17–19; 26, 33) are provided for removing, selectively, each second or subsequent product from the transport system and guiding it into the auxiliary transport path, the auxiliary transport path having a path length which is longer by at least the length of one product than the transport distance of the transport system between the removal position and the return position, whereby, upon removal of a product and return of the removed product, the removed product will come to lie closely adjacent a neighboring product which was transported by the transport system without having been removed, to supply at least two then immediately adjacently positioned products to the rotary folding apparatus (7), and wherein the folding apparatus (7) has an axial length which is at least as long as the overall length of the adjacently positioned products being supplied thereto by the transport system beyond the return position.

2. Apparatus according to claim 1, wherein the means for providing the auxiliary transport path comprises a deflection drum (16) having a circumferential speed corresponding to the linear transport speed of the transport system;

and wherein the removal means comprises grippers (17, 18, 19) located on the deflection drum (16) to grip selected products being supplied by the transport system, and remove said products from the transport system, for subsequent repositioning of the products on the transport system.

3. Apparatus according to claim 2, wherein the circumference of the deflection drum (16) is approximately three times the length of a product.

4. Apparatus according to claim 1, wherein the means for providing an auxiliary transport path comprises an auxiliary transport belt system (28) operating at the same linear speed as the transport system (20);

wherein the removal means comprises a deflection switch (33) selectively deflecting products from the transport system to the auxiliary transport path, or leaving the products on the transport system, and operating in synchronism with the arrival of products at the deflection switch, and wherein the auxiliary transport belt system (28) includes inclined portions for guiding products deflected by the switch to the auxiliary transport belt system and to reposition products from the auxiliary transport belt system on said transport system (20).

5. Apparatus according to claim 4, wherein the length of the auxiliary transport belt system, and measured from the removal position to the return position, is about one product length longer than the length of the transport system (23) between the removal and return positions.

6. Apparatus according to claim 1, wherein the folding apparatus includes a fixed stop (12) to receive the leading edge of a product being supplied thereto by the transport system;

and a movable stop (13) to receive the leading edge of a subsequent product being supplied thereto and immediately adjacent the first product, the movable stop being movable out of the path of feed of products to the folding apparatus to permit feeding of the first product to the fixed stop and then positioning of the movable stop for receiving the immediately adjacent subsequent product.

7. In a combination of a rotary folding apparatus (7) to form a transverse fold in printed products with a transport system (1, 20) feeding printed products with spaces of about the length of a printed product therebetween to the folding apparatus, a method of repositioning the products on the transport system to place two products immediately adjacent each other with a gap between succeeding, adjacently positioned products which is approximately twice as long as the length of any one product, comprising the steps of removing, selectively, a first product (*6a*, *6u*, *25a*) arriving at a removal position from the transport path;

guiding said first product in an auxiliary path which is at least as long as the length of the product plus the space between adjacent products being supplied to the removal position;

and redepositing said first product immediately adjacent a subsequently supplied product on the transport path, the subsequently supplied product being permitted to pass on the transport path without removal or deflection therefrom.

8. Method according to claim 7, wherein the step of repositioning the first product comprises positioning the first product behind a subsequently supplied product.

9. Method according to claim 7, wherein the step of repositioning the first product comprises positioning the first product behind a subsequently supplied product;

and including the further step of feeding a subsequent third product along the transport path, to place the first removed product between sequentially supplied second and third products to form a gap between groups of products positioned immediately adjacent each other, which is about three times the length of any one product.

10. Method according to claim 7, wherein the step of repositioning the removed product comprises repositioning the removed product immediately in advance of a subsequently supplied second product and in the space between a first and second product being supplied by the transport system.

* * * * *